US007548017B2

(12) United States Patent
Ando

(10) Patent No.: US 7,548,017 B2
(45) Date of Patent: Jun. 16, 2009

(54) SURFACE CONDUCTION ELECTRON EMITTER DISPLAY

(75) Inventor: Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 11/165,511

(22) Filed: Jun. 24, 2005

(65) Prior Publication Data

US 2005/0285503 A1 Dec. 29, 2005

(30) Foreign Application Priority Data

Jun. 29, 2004 (JP) ..... 2004-191008

(51) Int. Cl.
*H01J 1/62* (2006.01)

(52) U.S. Cl. ..... 313/495; 313/292

(58) Field of Classification Search ..... None
See application file for complete search history.

(56) References Cited

U.S. PATENT DOCUMENTS

| | | | | |
|---|---|---|---|---|
| 5,760,538 | A | 6/1998 | Mitsutake et al. | 313/422 |
| 5,905,335 | A * | 5/1999 | Fushimi et al. | 313/495 |
| 5,936,343 | A | 8/1999 | Fushimi et al. | 313/495 |
| 5,990,613 | A | 11/1999 | Ageno et al. | 313/495 |
| 6,053,791 | A | 4/2000 | Fujii et al. | 445/6 |
| 6,140,761 | A * | 10/2000 | Fushimi et al. | 313/495 |
| 6,144,154 | A * | 11/2000 | Yamazaki et al. | 313/495 |
| 6,184,619 | B1 | 2/2001 | Yamazaki et al. | 313/495 |
| 6,265,822 | B1 * | 7/2001 | Kuroda et al. | 313/495 |
| 6,278,233 | B1 * | 8/2001 | Sanou et al. | 313/495 |
| 6,288,485 | B1 * | 9/2001 | Takegami et al. | 313/495 |
| 6,351,065 | B2 * | 2/2002 | Yamazaki et al. | 313/497 |
| 6,366,014 | B1 * | 4/2002 | Kuroda et al. | 313/495 |

(Continued)

FOREIGN PATENT DOCUMENTS

CN 1165394 A 11/1997

(Continued)

OTHER PUBLICATIONS

J. Puetz, G. Gasparro and M. A. Aegerter, Liquid film spray deposition of transparent conducting oxide coatings, Thin Solid Films, vol. 442, Issues 1-2, Selected papers from the 4th International Conference on Coatings on Glass, Oct. 1, 2003, pp. 40-43; doi:10.1016/S0040-6090(03)00936-2.*

*Primary Examiner*—Toan Ton
*Assistant Examiner*—Britt Hanley
(74) *Attorney, Agent, or Firm*—Fitzpatrick, Cella, Harper & Scinto

(57) ABSTRACT

The invention provides an image forming apparatus in which orbit shift can be prevented to perform good image display in an electron beam emitted from the electron-emitting device adjacent to the spacer when an antistatic spacer coated with a high resistance film is used. A surface shape is controlled by forming a fine particle film on the surface of a row directional wiring 5 in which a spacer 3 is arranged, the electron emission is realized from electron-emitting areas 14*a* and 14*b* near contacting areas 15*a* and 15*b* in a non-contacting area 16 in which the spacer 3 is not in contact with the row directional wiring 5, and the non-contacting area 16 of the spacer 3 is irradiated with the electron to decrease a potential, which allows a good equipotential line 17 to be formed.

5 Claims, 9 Drawing Sheets

U.S. PATENT DOCUMENTS

| | | | | |
|---|---|---|---|---|
| 6,441,544 | B1 | 8/2002 | Ando et al. | 313/310 |
| 6,472,813 | B2 * | 10/2002 | Mitsutake et al. | 313/495 |
| 6,512,329 | B1 * | 1/2003 | Mitsutake et al. | 313/495 |
| 6,534,911 | B1 * | 3/2003 | Ando | 313/496 |
| 6,712,665 | B2 * | 3/2004 | Fushimi et al. | 445/24 |
| 6,759,802 | B2 | 7/2004 | Ando | 313/495 |
| 6,802,753 | B1 | 10/2004 | Ando et al. | 445/6 |
| 6,803,715 | B1 * | 10/2004 | Mitsutake et al. | 313/495 |
| 6,878,028 | B1 | 4/2005 | Fujii et al. | 445/6 |
| 6,884,138 | B1 | 4/2005 | Ando et al. | 445/24 |
| 6,946,786 | B2 | 9/2005 | Ando | 313/496 |
| 6,984,160 | B2 | 1/2006 | Ando et al. | 445/24 |
| 7,005,797 | B2 | 2/2006 | Ando | 313/495 |
| 7,038,371 | B2 * | 5/2006 | Fushimi | 313/495 |
| 7,053,537 | B2 | 5/2006 | Hiroike et al. | 313/292 |
| 7,075,223 | B2 | 7/2006 | Ando | 313/495 |
| 2001/0024085 | A1 * | 9/2001 | Abe et al. | 313/495 |
| 2002/0003401 | A1 * | 1/2002 | Yamazaki et al. | 313/497 |
| 2002/0109455 | A1 * | 8/2002 | Mitsutake et al. | 313/495 |
| 2003/0124945 | A1 * | 7/2003 | Fushimi et al. | 445/24 |
| 2003/0164675 | A1 | 9/2003 | Ando | 313/495 |
| 2004/0227453 | A1 | 11/2004 | Ando et al. | 313/495 |
| 2005/0162065 | A1 | 7/2005 | Kojima et al. | 313/495 |
| 2005/0253068 | A1 * | 11/2005 | Ito et al. | 250/310 |
| 2005/0264166 | A1 | 12/2005 | Ando | 313/495 |
| 2006/0049744 | A1 | 3/2006 | Ando | 313/496 |
| 2006/0141892 | A1 | 6/2006 | Hiroike et al. | 445/24 |

FOREIGN PATENT DOCUMENTS

| | | | |
|---|---|---|---|
| CN | 1288583 | A | 3/2001 |
| JP | 8-180821 | | 7/1996 |
| JP | 10-334834 | | 12/1998 |
| JP | 2003303540 | * | 10/2003 |

* cited by examiner

SURFACE CONDUCTION ELECTRON EMITTER DISPLAY

BACKGROUND OF THE INVENTION

1. Field of the Invention

The present invention relates to an image forming apparatus which is used as, e.g. a display panel. More particularly, the invention relates to the image forming apparatus in which a spacer is sandwiched along wiring between a first substrate, which has plural electron-emitting devices and the wiring for driving the electron-emitting devices, and a second substrate, which has an electrode defined at a voltage higher than that of the wiring.

2. Related Background Art

Generally, in the image forming apparatus in which the first substrate on the electron source side and the second substrate on the display surface side are arranged in an opposite manner while separated from each other, the spacer made of an insulating and the second substrate in order to withstand atmospheric pressure. However, the spacer is charged to affect an electron beam orbit near the spacer, which generates a problem in that light-emission position is shifted. This causes the image deterioration such as a decrease in luminance and bleeding in pixels near the spacer.

Conventionally, in order to prevent the charge of the spacer, it is known that the spacer coated with a high resistance film is used.

Specifically, it is known that the rib-shaped spacer coated with the high resistance film is sandwiched along the first-substrate wiring so that the high resistance film is electrically connected to the first-substrate wiring and the second-substrate electrode, or it is known that a spacer electrode is provided above and below the spacer coated with the high resistance film and the high resistance film is sandwiched between the wiring and the electrode through the spacer electrode so as to be electrically connected (for example, see Japanese Patent Application Laid-Open No. H8-180821 (U.S. Pat. No. 5,760,538)).

It is also proposed that intermediate layers (spacer electrode) having the electrical conductivity are provided on side faces on the first substrate side and second substrate side of the spacer coated with the high resistance film respectively and the electron beam orbit is controlled by the intermediate layer (spacer electrode) (for example, see Japanese Patent Application Laid-Open No. H10-334834 (U.S. Pat. No. 6,184,618)).

However, according to the inventors' study, for the image forming apparatus described in Japanese Patent Application Laid-Open No. H8-180821 in which the high resistance film is electrically connected to the first-substrate wiring and the second-substrate electrode without arranging the spacer electrode, it is newly found that sometimes the charge of the spacer is not sufficiently eliminated or sometimes the potential distribution of the spacer surface exhibits the unintentional distribution state.

Since the above-described phenomena depend largely on a process of manufacturing the display apparatus, the cause of the phenomena is not generalized. For example, the unpredictable distortion is generated between the first-substrate wiring and the second-substrate electrode, a foreign matter exists on the first-substrate wiring and the second-substrate electrode, and an unintentional burr is generated in the wring or the electrode. Therefore, the contact is not continuously achieved between the high resistance film of the spacer and the wiring or the electrode, and the position in which the high resistance film of the spacer is not partially in contact with the wiring or the electrode is generated, which causes the insufficient electrical contact. Particularly, in the wiring produced by the inexpensive manufacturing method, sometimes there is the partial difference in the surface shape, and the electrical contact failure is easy to be generated.

In the above case, not only the charge of the spacer is not sufficiently eliminated, but also the irregular change is generated in the potential distribution of the spacer surface, which results in the problem that the electron beam orbit does not corresponds to the design. Further, since the electron beam is accelerated from the first substrate to the second substrate, the orbit change emerges more remarkably by deflection force on the first substrate side compared with the second substrate side.

Referring to FIG. 10, the electron beam deflection caused by the potential distribution of the spacer surface on the first substrate side will specifically be described.

FIG. 10A shows the potential distribution of the surface of a spacer 3 when the high resistance film comes unintentionally into partial contact with wiring 5 of the first substrate in ranging the thin-plate-shaped spacer 3 coated with the high resistance film along the wiring 5. FIG. 10B is an equivalent circuit view of FIG. 10A. The numeral 11 in the drawing designates a second-substrate electrode, and the numeral 17 designates an equipotential line.

As shown in FIGS. 10A and 10B, assuming that resistance between a point C and a point A is R1, the corresponding resistance between a point D and the point B becomes R1 at the point B which is of a non-contacting area, the potential at the point B is increased by voltage drop generated by resistance R2 between the point A and the point B, when compared with the point A. Therefore, the orbit of the electron beam emitted from the electron-emitting device near the point B exhibits behavior different from the orbit of the electron emitted from the electron-emitting device near the point A, which results in the difference in image (distortion) between the point A and the point B.

On the other hand, for the image forming apparatus also described in Japanese Patent Application Laid-Open No. 8-180821 and Japanese Patent Application Laid-Open No. 10-334834 in which the spacer electrode is provided above and below the spacer coated with the high resistance film and the high resistance film is connected to the first-substrate wiring and the second-substrate electrode through the spacer electrode, an electric field distribution is generated near an area where the spacer electrode is exposed to the side face of the spacer. Although the electric field is substantially even in a lengthwise direction of the spacer (direction parallel to the wiring), the electric field emerges strongly when compared with the case in which the spacer electrode is not exposed. Therefore, an arrival position of the electron beam radiated from the adjacent electron-emitting device is easily largely disturbed due to misalignment in arranging the spacer. It is also found that the exposure of the spacer electrode to the side face of the space causes the discharge to largely decrease image quality. In order to prevent the large decrease in image quality, it is necessary that the spacer electrode is not exposed to the side face of the spacer, or it is necessary that the spacer is arranged with high accuracy, which causes the cost increase.

SUMMARY OF THE INVENTION

In view of the foregoing, an object of the invention is to prevent irregular shift of the electron beam emitted from the electron-emitting device adjacent to the spacer when the plate-shaped spacer coated with an antistatic high resistance film is used. Another object of the invention is to suppress the position shift of the arrival position of the electron beam emitted from the adjacent electron-emitting device even if the spacer arranging position is slightly shifted. Another object of the invention is to adapt the spacer having the same configuration to various apparatus modes.

In order to achieve the above object, the present invention provides an image forming apparatus comprising:

a face plate which has a luminescent member and an electrode, the luminescent member emitting light by electron irradiation, the electrode being defined by a first potential;

a rear plate which has a plurality of electron-emitting devices and a plurality of wirings, the wirings being connected to the electron-emitting device and defined by a second potential different from the first potential; and a spacer which is arranged between the wiring and the electrode while being partially in contact with the wiring, the spacer being electrically connected to the wiring and the electrode, an end face which faces the rear plate having resistivity in the spacer, wherein an electron-emitting area for emitting an electron onto the spacer is arranged on the wiring in a non-contacting area between the wiring and the spacer in the vicinity of contacting area between the wiring and the spacer.

DETAILED DESCRIPTION OF THE PREFERRED EMBODIMENTS

Figure 1:
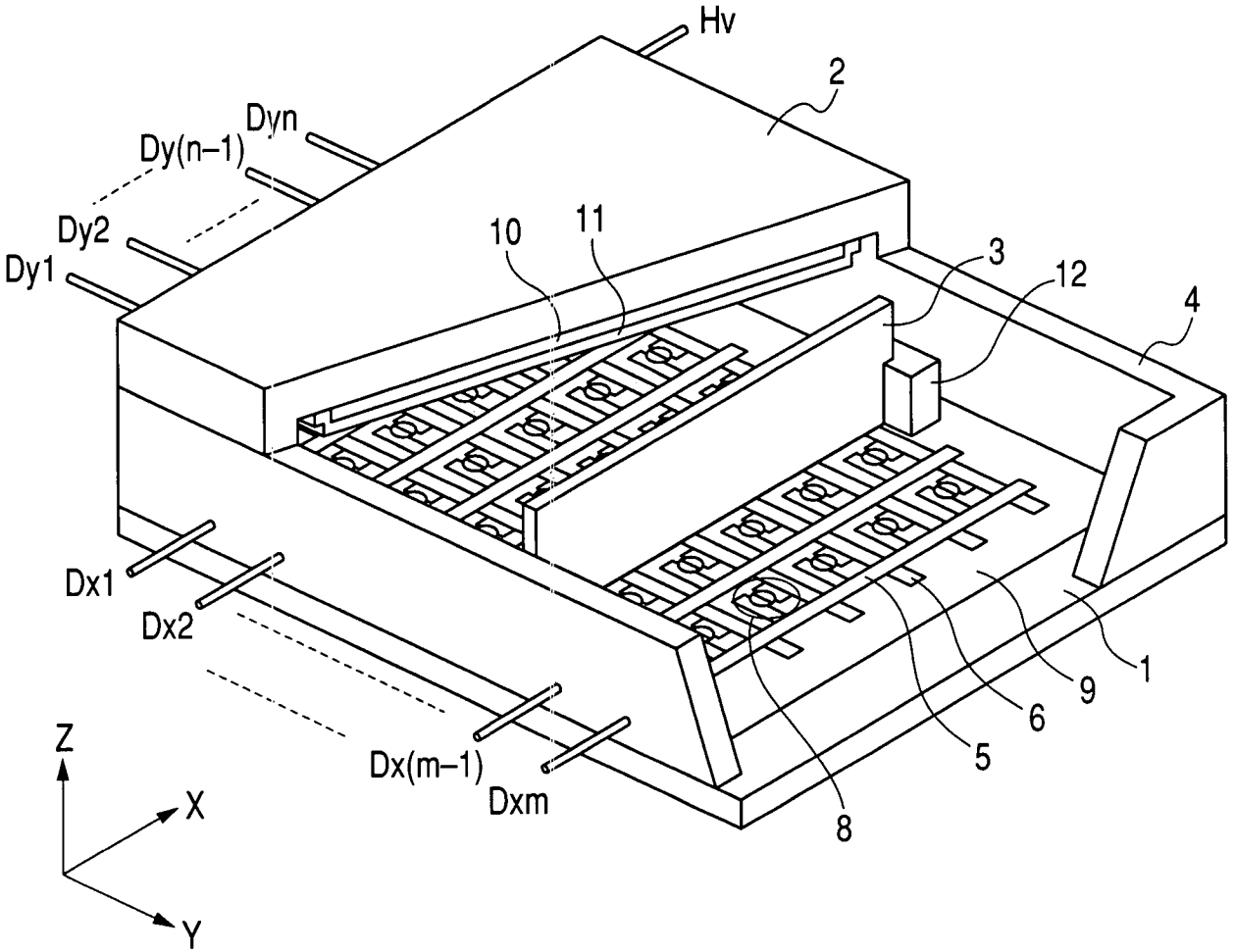
FIG. 1 is a perspective view showing a structure of a display panel of an image forming apparatus according to a preferred embodiment of the invention.

Referring now to the drawings, the invention will specifically be described.

Figure 2A:
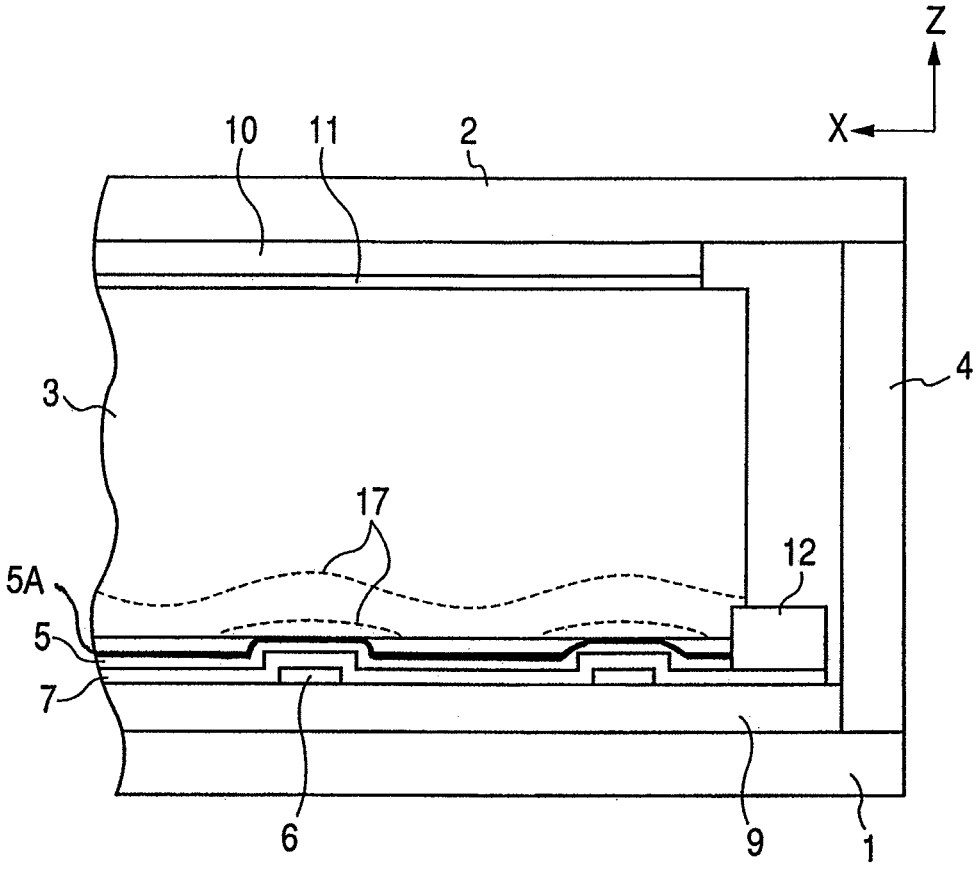
FIGS. 2A and 2B are a partially enlarged schematic view showing the display panel of FIG. 1 and a schematic view showing an abutting surface between a row directional wiring and a spacer.
Figure 2B:
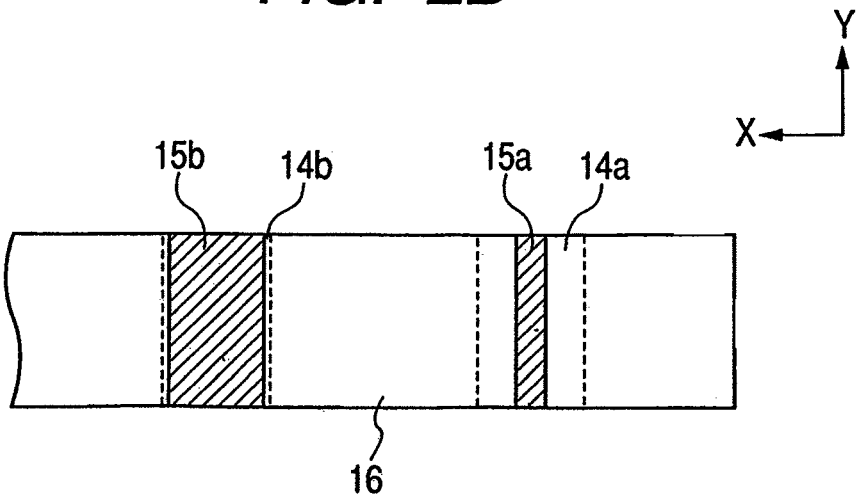

FIG. 1 is a perspective view showing a structure of a display panel of an image forming apparatus according to a preferred embodiment of the invention, and FIG. 1 also shows a part of the structure while cut off. FIG. 2A shows a partially enlarged schematic view of the display panel of FIG. 1, and FIG. 2B shows a schematic view of an abutting surface between row directional wiring and a spacer 3 in FIG. 2A.

As shown in FIG. 1, in the display panel of the embodiment, a rear plate 1 which is the first substrate and a face plate 2 which is the second substrate face each other at a predetermined interval, and the inside is kept in vacuum by sandwiching the plate-shaped spacer 3 between the rear plate 1 and the face plate 2 while a periphery is sealed by a side wall 4.

An electron source substrate 9 is fixed onto the rear plate 1. Row directional wiring 5, column directional wiring 6, an interlayer insulating layer 7 (see FIG. 2A), and an electron-emitting device 8 are formed on the electron source substrate 9.

The illustrated electron-emitting device 8 is a surface conduction electron-emitting device in which an electroconductive thin film having an electron-emitting region is connected between a pair of device electrodes. The display panel of the embodiment has multi-electron beam sources, in which the surface conduction electron-emitting devices 8 are arranged in an N-by-M matrix M-line and matrix wiring is formed by the M-line row directional wiring 5 and the N-line column directional wiring 6. The row directional wiring 5 is located on the column directional wiring 6 through the interlayer insulating layer 7. A scanning signal is applied to the row directional wiring 5 through extraction terminals Dx1 to Dxm, and a modulation signal (image signal) is applied to the column directional wiring 6 through extraction terminals Dy1 to Dyn.

The row directional wiring 5 and the column directional wiring 6 can be formed by applying silver paste by screen printing. It is also possible that the row directional wiring 5 and the column directional wiring 6 can be formed by photolithography.

In addition to the silver paste, other electroconductive materials can be used as the material of the row directional wiring 5 and the column directional wiring 6. For example, in the case where the row directional wiring 5 and the column directional wiring 6 is formed by the screen printing, it is possible to use the application material in which metal and glass paste are mixed. In the case where the row directional wiring 5 and the column directional wiring 6 is formed by using the plating to deposit the metal, it is possible to use a plating bath material.

A phosphor film 10 is formed on a lower surface (face opposite the rear plate 1) of a face plate 2. Because the display panel of the embodiment is a color display, three-primary-color phosphors of red (R), green (G), and blue (B) are applied in phosphor film 10 respectively. Each color phosphor is applied in a stripe shape, and a black conductive material (black strip) is provided between the stripe-shaped phosphors. The reasons why the black conductive material is provided are as follows. The generation of the shift is prevented in the display color even if the irradiating position of the electron beam is slightly shifted, the reflection of the external light is prevented to decrease in display contrast, and the phosphor film charge-up caused by the electron beam is prevented. The material mainly containing black lead can be used as the black conductive material. However, other materials can also be used as long as the material is applicable to the above purposes. A delta array and other arrays can be used as the method of applying the three-primary-color phosphors in addition to the stripe shape.

A metal back (accelerating electrode) 11 which is the electroconductive member is provided on the surface of the phosphor film 10. The metal back 11 accelerates and raises the electron emitted from the electron-emitting device 8. A high voltage is applied from a high-voltage terminal Hv to set the metal back 11 at the higher potential when compared with the row directional wiring 5. In the case of the display panel in which the surface conduction electron-emitting device, usually potential difference ranging from about 5 kV to 20 kV is formed between the row directional wiring 5 and the metal back 11.

The plate-shaped spacer 3 is attached onto the row directional wiring 5 while being in parallel with the row directional wiring 5. Both ends of the spacer 3 are supported by and attached to blocks fixing spacer 12 while the spacer 3 is positioned on the row directional wiring 5. When the spacer 3 is fixed by the blocks fixing spacer 12, kinetic energy of the electron is small, which allows the turbulence of the electric field to be decreased near the electron-emitting device 8 where the electric field is easy to affect the electron orbit.

Usually the plural spacers 3 are provided at regular intervals in order that the display panel has atmospheric pressure resistance. The spacer 3 is sandwiched between the rear plate 1 and the face plate 2. The rear plate 1 has the electron-emitting device 8 and the electron source substrate 9 in which the row directional wiring 5 and column directional wiring 6 for driving the electron-emitting device 8 are provided. The phosphor film 10 and the metal back 11 are provided in the face plate 2. The upper and lower surface of the spacer 3 are in contact with the metal back 11 and the row directional wiring 5 while pressurized respectively. The side wall 4 is sandwiched between the peripheries of the rear plate 1 and the face plate 2. The connection portion between the rear plate 1 and the side wall 4 and the connection portion between the face plate 2 and the side wall 4 are sealed by frit glass respectively.

Describing the spacer 3 more detail, the spacer 3 has insulating properties for withstanding the high voltage applied between the row directional wiring 5 and the column directional wiring 6 on the rear plate 1 side and the metal back 11 on the face plate 2 side, and the spacer 3 also has the electrical conductivity to such a extent that the charge is prevented in the surface of the spacer 3. In spacer 3 of the invention, at least the end face facing the rear plate 1 has the resistivity. As shown in FIG. 5, desirably the spacer 3 is formed by a substrate 51 made of the insulating material and a high resistance film 52 with which the surface of the substrate 51 is coated.

Quartz glass, glass in which a content of impurities such as Na is decreased, soda lime glass, ceramics such as alumina can be cited as an example of the material for the substrate 51 of the spacer 3. In the material of the substrate 51, it is preferable that thermal expansion coefficient is similar to or close to the coefficients of the electron source substrate 9, the rear plate 1, the face plate 2, and the like.

Electric current, in which an accelerating voltage Va applied to the metal back 11 on the high-potential side is divided by a resistance value of the high resistance film 52, is passed through the high resistance film 52 with which the surface of the spacer is coated, which allows the charge to the surface of the spacer 3 to be prevented. Therefore, from the viewpoints of the charge and electrical power consumption, the resistance value of the high resistance film 52 is set at a desirable range. From the viewpoint of the charge prevention, it is preferable that sheet resistance of the high resistance film 52 is 1014 Ω/□ or less, it is more preferable that the sheet resistance is 1012 Ω/□ or less, and it is the most preferable that the sheet resistance is 1011 Ω/□ or less. The lower limit of the sheet resistance of the high resistance film 52 depends on the shape of the spacer 3 and the voltage (potential difference between the row directional wiring 5 and the metal back 11) applied to the spacer 3. In order to suppress the electrical power consumption, it is preferable that the lower limit of the sheet resistance is 105 Ω/□ or more, and it is more preferable that the sheet resistance of the high resistance film 52 is 107 Ω/□ or less.

While the morphology of the thin film depends on surface energy of the material constituting the high resistance film 52, adhesion properties to the substrate 51, and temperature of the substrate 51, usually the thin film having thickness of 10 nm or less is formed in an island shape. In the thin film having thickness of 10 nm or less, the resistance is unstable, and reproducibility is low. On the other hand, when the film thickness is 1 μm or more, film stress becomes large to increase danger of film peel, and productivity becomes worse because the deposition time is lengthened. Accordingly, it is preferable that the thickness of the high resistance film 52 formed on the substrate 51 ranges from 10 nm to 1 μm, and it is more preferable that the film thickness ranges from 50 nm to 500 nm. Since the sheet resistance is ρ/t (ρ: specific resistance and t: film thickness), in consideration of preferable ranges of the sheet resistance and the film thickness, it is preferable that the specific resistance ρ of the high resistance film 52 ranges from 0.1 to 108 Ωcm. In order to realize the more preferable ranges of the sheet resistance and the film thickness, it is preferable that specific resistance ranges from 102 Ωcm to 106 Ωcm.

For example, metal oxide can be used as the high resistance film 52. Among others, it is preferable that chrome oxide, nickel oxide, and copper oxide are used as the high resistance film 52. Because the secondary electron emission efficiency is relatively low in these oxides, it is difficult that the spacer 3 is charged, even if the electron emitted from the electron-emitting device 8 hits the spacer 3. In addition to the above metal oxides, carbon is the preferable material because the secondary electron emission efficiency is small. Particularly, because amorphous carbon has high resistance, the proper surface resistance of the spacer 3 is easily obtained when the amorphous carbon is used as the high resistance film 52.

A nitride of aluminum and a transition metal is preferably used as the high resistance film 52. The resistance value can be controlled in the wide ranged from the good conductive material to the insulating material by adjusting a composition of the transition metal, and the change in resistance value is stably small in the display panel manufacturing process. Ti, Cr, and Ta can be cited as an example of the transition metal elements.

The nitride films can be formed by the thin-film forming techniques utilizing a nitrogen gas atmosphere, such as sputtering, electron beam evaporation, ion plating, and ion-assist evaporation. The metal oxide film can be formed by the thin-film forming technique utilizing oxygen gas atmosphere. In addition, the metal oxide film can also be formed by a CVD method and an alkoxide applying method. The carbon film is produced by the evaporation, the sputtering, the CVD method, and a plasma CVD method. The amorphous carbon film can be obtained by containing hydrogen in the deposition atmosphere or by using hydrocarbon gas as the deposition gas.

As described above, the spacer 3 is sandwiched between the rear plate 1 and the face plate 2, the high resistance film 52 coating the surface of the spacer 3 is in contact with the wiring (row directional wiring 5 in the embodiment) on the rear plate 1 side and the electroconductive member (metal back 11 in the embodiment) on the face plate 2 side while pressurized, and the high resistance film 52 is electrically connected to the wiring on the rear plate 1 side and the electroconductive member on the face plate 2 side respectively. As shown in FIG. 2A, because an intersecting portion of the row directional wiring 5 and the column directional wiring 6 is projected by the thickness of the column directional wiring 6 toward the face plate 2 side from other points, the electrical connection between the spacer 3 and the row directional wiring 5 is performed by causing the projected portion to come into contact with the high resistance film 52. Namely, as shown in FIG. 2B, the electrical connection between the high resistance film 52 and the row directional wiring 5 is performed at the intervals of the intersecting portions such that the intersecting portion of the row directional wiring 5 and the column directional wiring 6 becomes the contacting areas 15*a* and 15*b* and other portions except for the intersecting portion become the non-contacting portion 16.

Figure 10A:
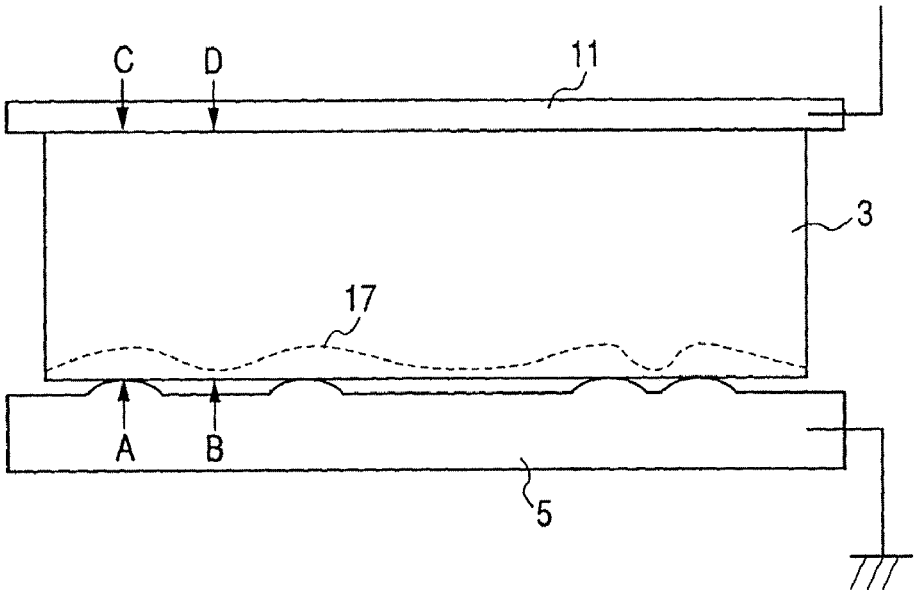
PRIOR ART FIG. 10A
FIGS. 10A and 10B are a view for explaining electron beam deflection depending on a potential distribution of a spacer surface in the conventional image forming apparatus.
Figure 10B:
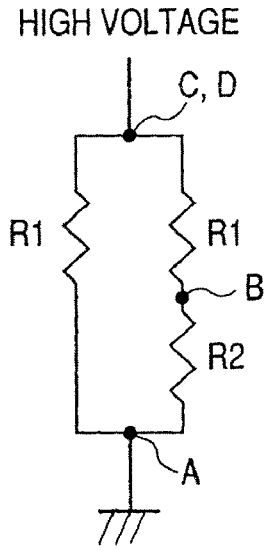
PRIOR ART FIG. 10B

As can be seen from an equipotential line 17 shown in FIG. 2A and FIG. 2B, the high resistance film 52 also exists in the non-contacting area 16 in the spacer 3, so that the potential of the spacer 3 is raised near the non-contacting areas 15*a* and 15*b*. As described above referring to FIG. 10, in the current paths from the metal back 11 to the contacting areas 15*a* and 15*b*, since the resistance value of the current path through the non-contacting area 16 is larger than that of the current path which is not passed through the non-contacting area 16 (for example, current path from the portion directly above the contacting areas 15*a* and 15*b*), the potential is raised by the increased resistance value, which generates the raise in potential of the spacer.

The inventor found that the electron is emitted toward the spacer 3 from the row directional wiring 5 in the non-contacting area 16 near the contacting areas 15*a* and 15*b* under a certain condition. Namely, the electron-emitting properties can be added to a part of the row directional wiring 5 by controlling the surface shape of the row directional wiring 5.

Specifically, surface roughness is controlled so as to have an appropriate electric field enhancement factor β. As the electric field enhancement factor β is increased, the electron is easy to emit. However, in order to prevent the electron emission in the undesirable portions (except for spacer 3 arrangement position), it is necessary to suppress the electric field enhancement factor β to a certain degree. Examples of the method of controlling the electric field enhancement factor β include the method of changing a baking temperature in forming the row directional wiring 5 by the printing, the method of changing the paste material, the method of dispersing fine particles in the paste, and the method of applying a fine particle film 5A after the row directional wiring 5 is formed.

Among others, the method of applying the material in which the electroconductive super-fine particles mainly containing the carbon material, tin oxide, and chrome oxide are dispersed in an organic solvent is preferable, because the stable surface shape and electric field enhancement factor β are obtained.

The optimum electric field enhancement factor β is determined by the later-mentioned "electric field in a steady state." The electric field in the steady state is determined by the accelerating voltage, the shape of the spacer 3, a physical contacting length between the spacer 3 and the row directional wiring 5, a gap between the spacer 3 and the row directional wiring 5, the surface state of the row directional wiring 5, and the like. Namely, the value of the electric field enhancement factor β is selected such that the electron is stably emitted at the desired position near the spacer while the electron emission is not performed in other positions.

Thus, since the optimum electric field enhancement factor β is determined by the many parameters, it is preferable, though it depends, that the electric field enhancement factor β ranges from about 100 to about 1000.

The "electrical contact" can be secured in the range wider than the physical contacting area by the irradiation in the non-contacting area 16 near the contacting areas 15*a* and 15*b* with the electron irradiated from the row directional wiring 5 toward the spacer 3.

Figure 3A:
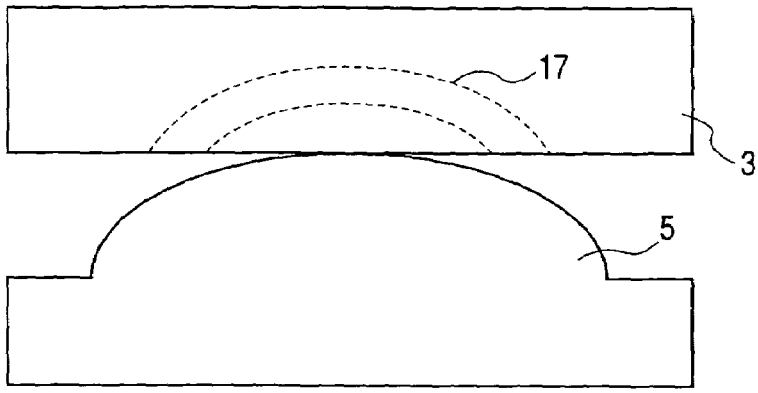
FIGS. 3A, 3B and 3C are an explanatory view showing an electrical contact between the spacer and the row directional wiring.
Figure 3B:
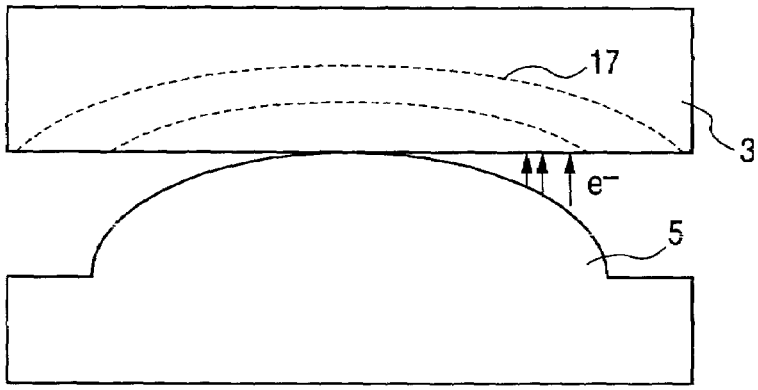
Figure 3C:
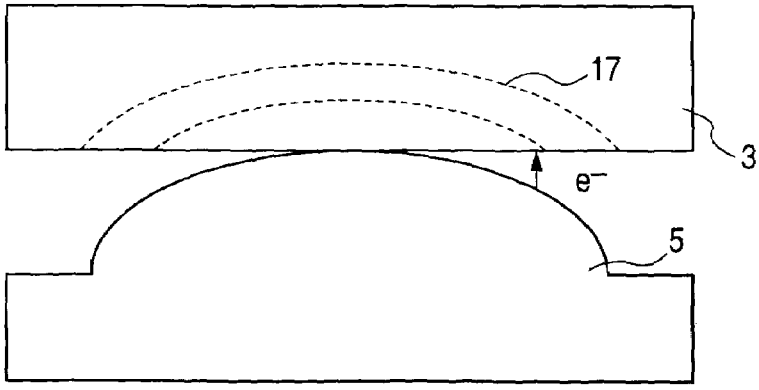

Referring to FIGS. 3A to 3C, the above state will be described below.

FIG. 3A shows the potential distribution of the initial state, i.e. before the non-contacting area 16 is irradiated with the electron from the row directional wiring 5 toward the spacer 3. In FIG. 3A, the numeral 17 designates the equipotential line. Then, as shown in FIG. 3B, the electron irradiation is started near the contacting areas 15*a* and 15*b*. In the area irradiated with the electron, since the electron energy is sufficiently small, the negative charge occurs to decrease the potential.

In FIG. 3C, the electron emission becomes the steady state, and the electric field in which the electron narrowly emitted is maintained (steady-state electric field).

As described above, when compared with FIG. 3A in which the electron is not emitted, in FIG. 3C in which the steady state is obtained as a result of the electron emission, it is found that the potential is decreased as if the contacting area is increased.

The equipotential line 17 near the rear plate 1 in the spacer 3 according to the invention is schematically shown by a broken line in FIG. 2A. FIG. 2B is a schematic view showing the contact state between the row directional wiring 5 and the spacer 3. The physical contacting area 15*a* is smaller than the physical contacting area 15*b*. The numerals 14*a* and 14*b* schematically designate the electron irradiating area. The electron irradiating areas 14*a* and 14*b* are substantially equal to each other while the physical contacting area 15*a* is different from the physical contacting area 15*b*.

It is difficult that the electron-emitting state is actually observed. However, as a result of earnest studies, it is found that the electron irradiating area can be estimated by observing the irradiated spacer surface after the irradiation. Specifically, an impression exists in the physical contacting area, and a color change area is recognized near the impression. When the spacer is separately irradiated with an electron gun, the similar color change is observed. Therefore, it is thought that the color change near the physical contacting area is caused by the electron irradiation.

As a result of the further detailed observation of the contacting area, the following features are observed.

Figure 4A:
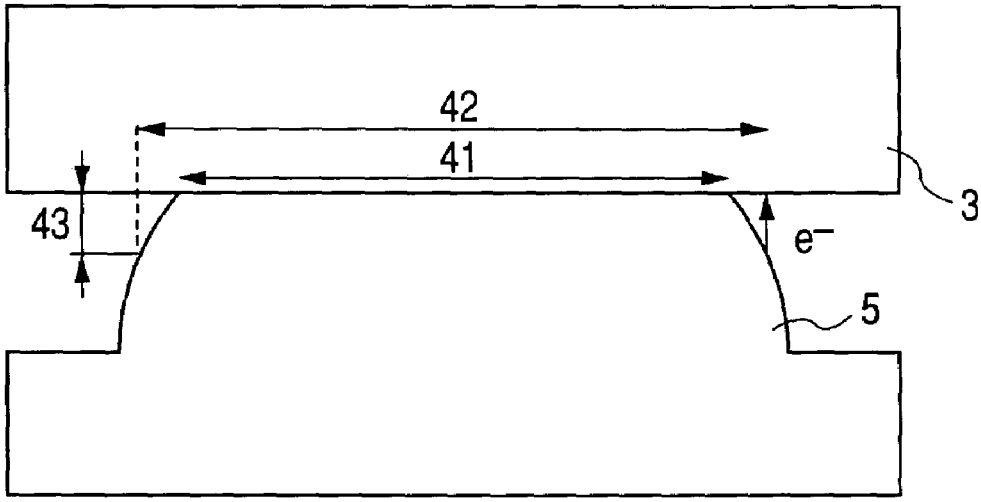
FIGS. 4A and 4B are an explanatory view showing an electrical contact between the spacer and the row directional wiring.
Figure 4B:
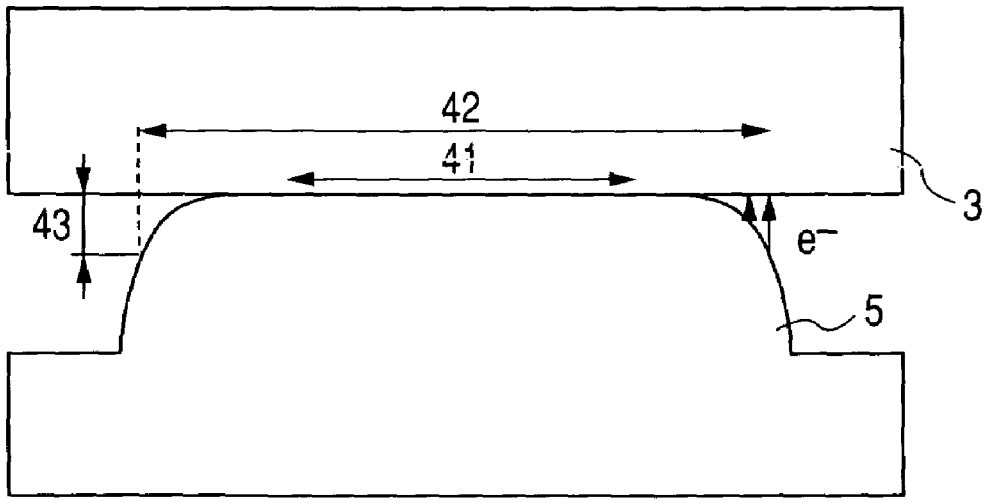

FIG. 4A is a schematic view in the case where the physical contacting area is large, and FIG. 4B is a schematic view in the case where the physical contacting area is small. In FIGS. 4A and 4B, the numeral 41 designates a physical contacting length (impression area), the numeral 42 designates an electrical contacting length (color change area), and the numeral 43 designates a gap length between the spacer 3 and the row directional wiring 5 in the outermost portion of the color change area. When FIGS. 4A and 4B are compared to each other, it is found that FIGS. 4A and 4B are substantially similar to each other in the electrical contacting length 42 and the gap length 43 while the difference exists in the physical contacting length 41. FIGS. 4A and 4B are also similar to each other in the actual arrival position of the electron beam. The actual arrival position of the electron beam corresponds to the result of the electron beam simulation assuming that the electrical contacting length 42 is a potential defining contacting area.

A portion, where the difference exists in the electron beam arrival position using the row directional wiring to which the fine particle film is not applied, is observed as a comparative experiment. As a result of the comparative experiment, it is confirmed that the difference exists in the electrical contacting length 42. Each result corresponds to the result of the electron beam simulation assuming that the electrical contacting length 42 is a potential defining contacting area.

Namely, the electron emission toward the spacer 3 from the row directional wiring 5 is controlled in the non-contacting area 16 near the contacting areas 15*a* and 15*b* by the application of the fine particles, which controls the beam position. In other words, even if FIGS. 4A and 4B differ from each other in the physical contacting state between the spacer 3 and the row directional wiring 5, the substantially same state can be realized in the electrical contacting state between the spacer 3 and the row directional wiring 5. Therefore, the control of the physical contacting state between the spacer 3 and the row directional wiring 5 can be relaxed.

Thus, at each contacting point, it is found that the good electron beam control can be performed by causing the electrical contacting lengths 42 of the FIGS. 4A and 4B to correspond to each other.

It is thought that the electrical contacting length 42 is determined by the steady-state electric field which is determined by the accelerating voltage, the spacer shape, the physical contacting length 41, the gap length 43, the surface state of the row directional wiring 5, and the like. However, there are many unclear points yet, and currently the design is not achieved using a theoretical computation. However, parameters can experimentally be determined while the color change area is observed.

Figure 9A:
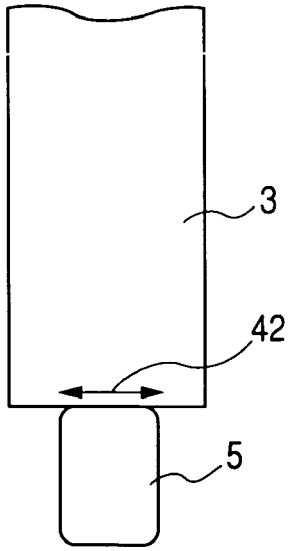
FIGS. 9A and 9B are a view showing the contacting state between the spacer and the row directional wiring according to another embodiment of the invention.
Figure 9B:
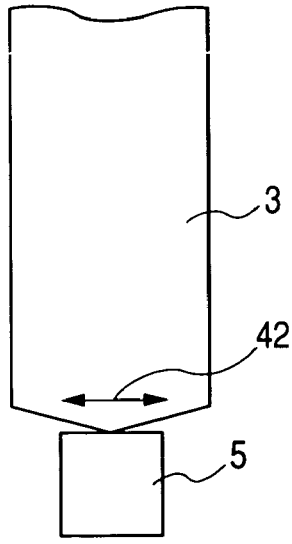

FIG. 9A shows the mode in which the row directional wiring 5 rises rapidly inside the thickness of the spacer 3 in the state in which the spacer 3 abuts on the row directional wiring 5 when the spacer 3 and the row directional wiring 5 are viewed from the X-direction of FIG. 1. FIG. 9B shows the mode in which the bottom surface of the spacer 3 is not flat. Even in the modes shown in FIGS. 9A and 9B, the "electrical contact" having the variations smaller than those of the physical contact can be realized by applying the invention.

As shown in FIGS. 1 and 2, since the pieces of column directional wiring 6 are arranged at regular intervals, the contacting areas 15*a* and 15*b* and the non-contacting area 16 are formed at regular intervals. Further, as can be seen from FIG. 1, since the electron-emitting device 8 is located between the two pieces of row directional wiring 5 and between the two pieces of the column directional wiring 6, all the electron-emitting devices 8 adjacent to the spacer 3 are located at the position adjacent to the non-contacting area 16. Therefore, all the electron beams emitted from the electron-emitting device 8 are evenly affected by the surface potential of the spacer 3 corresponding to the non-contacting area 16.

Figure 5A:
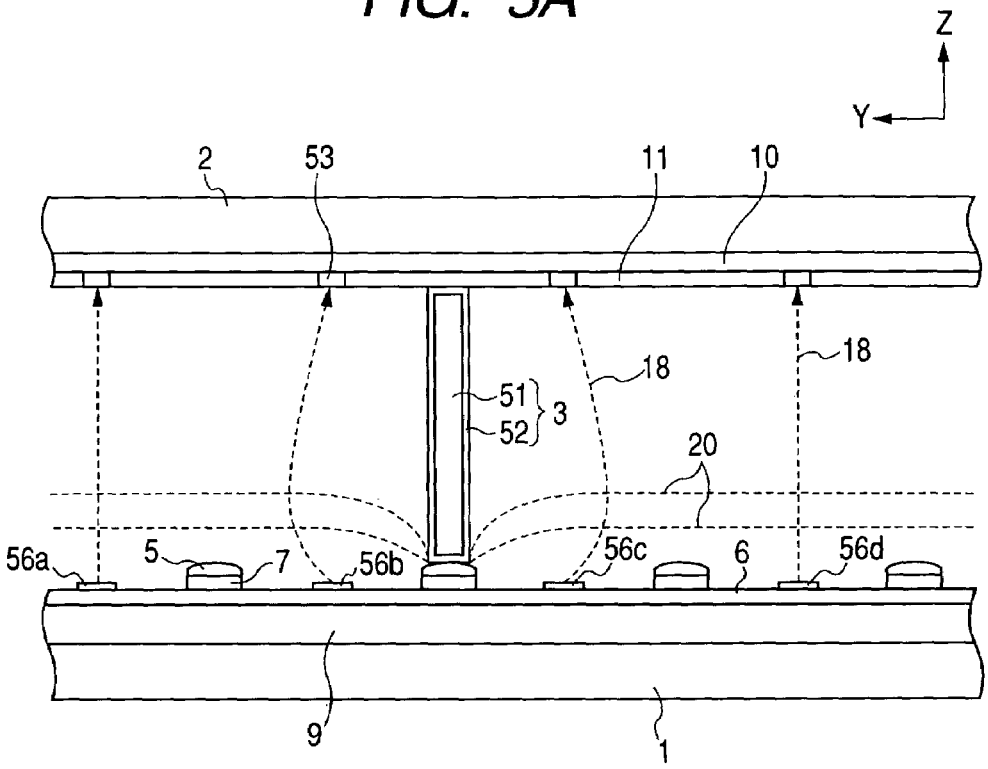
FIGS. 5A and 5B are a schematic view showing a structure of a display panel of an image forming apparatus according to another preferred embodiment of the invention.
Figure 5B:
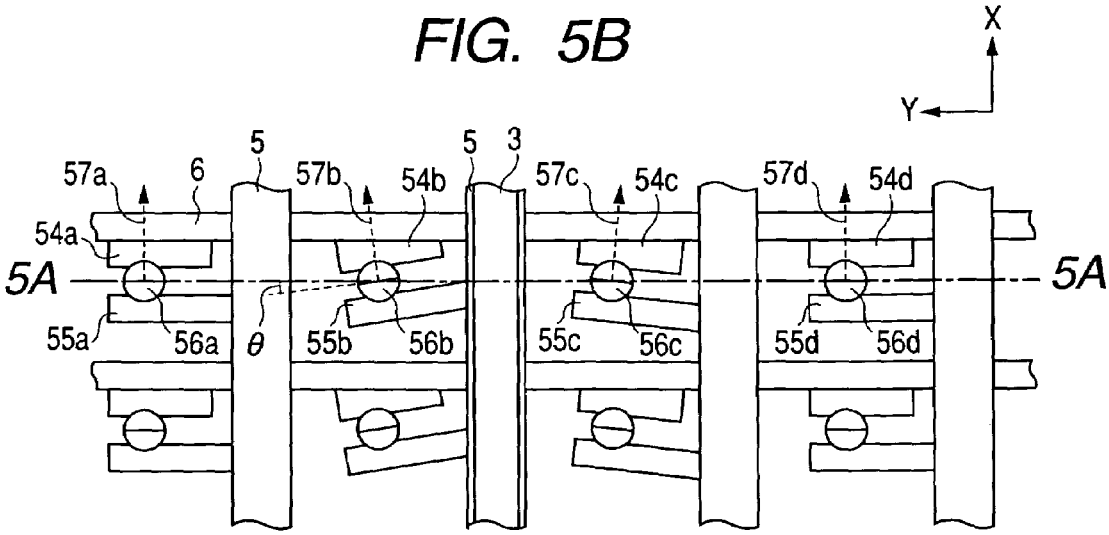

As schematically shown in FIG. 5B, in device electrodes of the electron-emitting device 8 of the embodiment, except for the device electrodes adjacent to the spacer 3 (54*b* and 55*b*, and 54*c* and 55*c*), the lengthwise directions of the gaps of pairs of device electrodes 54*a* and 55*a*, and 54*d* and 55*d* are provided in parallel with the column directional wiring 6. In the device electrodes 54*b* and 55*b*, and 54*c* and 55*c* of the electron-emitting devices adjacent to the spacer 3, the lengthwise directions of the device electrode gaps are provided with an angle of θ relative to the column directional wiring 6. Like an electron beam orbit 18 shown by the broken line in FIG. 5A, the electron emitted from the electron emitting device flies so as to be separated away from the spacer 3 in the electron-emitting portion, the electron flies so as to be brought close to the spacer 3 from the position near the bottom surface of the spacer 3, and finally the electron arrives at a desired predetermined irradiating position 19. FIG. 5A is a sectional view taken on line A5-5A of FIG. 5B. The reasons will be described in detail.

Near Electron-Emitting Portion

As schematically shown in FIG. 5B, the electron emitted with the initial velocities 57*a* to 57*d* from the device electrodes 55*a* to 55*d* having the negative potentials toward the device electrodes 54*a* to 54*d* having the positive potentials. In the device electrodes 54*b* and 55*b*, and 54*c* and 55*c* of the electron-emitting devices adjacent to the spacer 3, the lengthwise directions of the device electrode gaps are provided with the angle of θ relative to the column directional wiring 6. Therefore, in the electron emitted from the electron-emitting device adjacent to the spacer 3, because the electrons are emitted with the initial velocity vectors 57*b* and 57*c* having components separated from the spacer 3 (Y-direction component), the electrons have the orbit so as to be separated away from the spacer 3 near the electron-emitting portion. On the other hand, the initial velocity vectors 57*a* and 57*d* of the electrons emitted from the electron-emitting devices which are not adjacent to the spacer 3 have the orbit parallel to the spacer 3 because the initial velocity vectors 57*a* and 57*d* have no component separated away from the spacer.

Figure 6A:
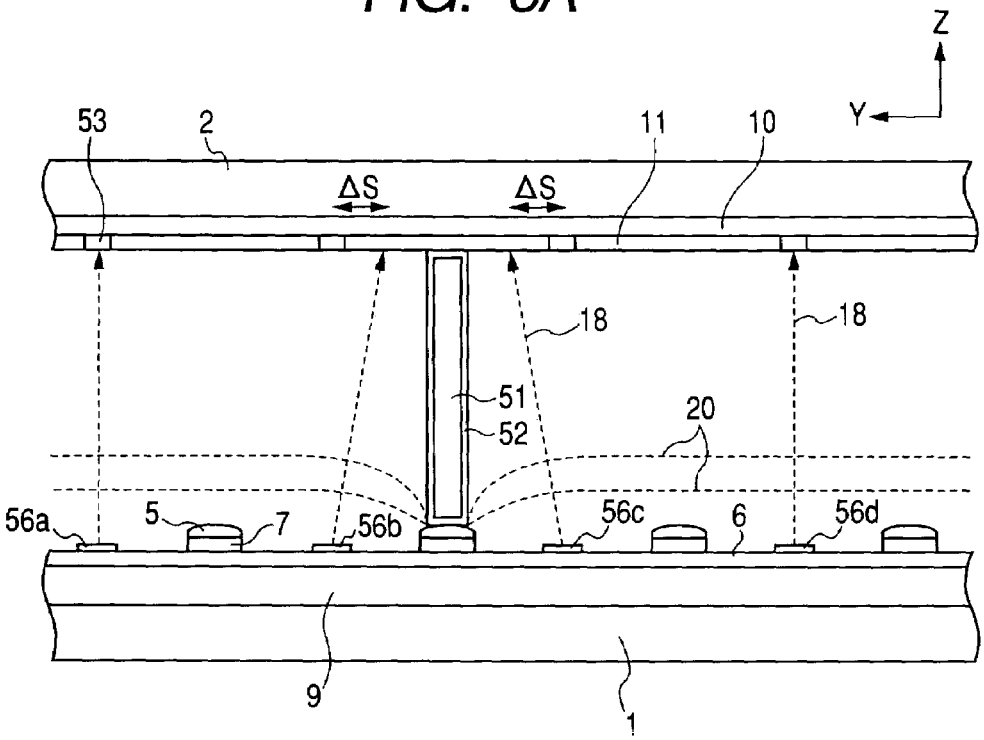
FIGS. 6A and 6B are a schematic view showing a configuration when device electrodes are formed in the same direction in the display panel of FIGS. 5A and 5B.
Figure 6B:
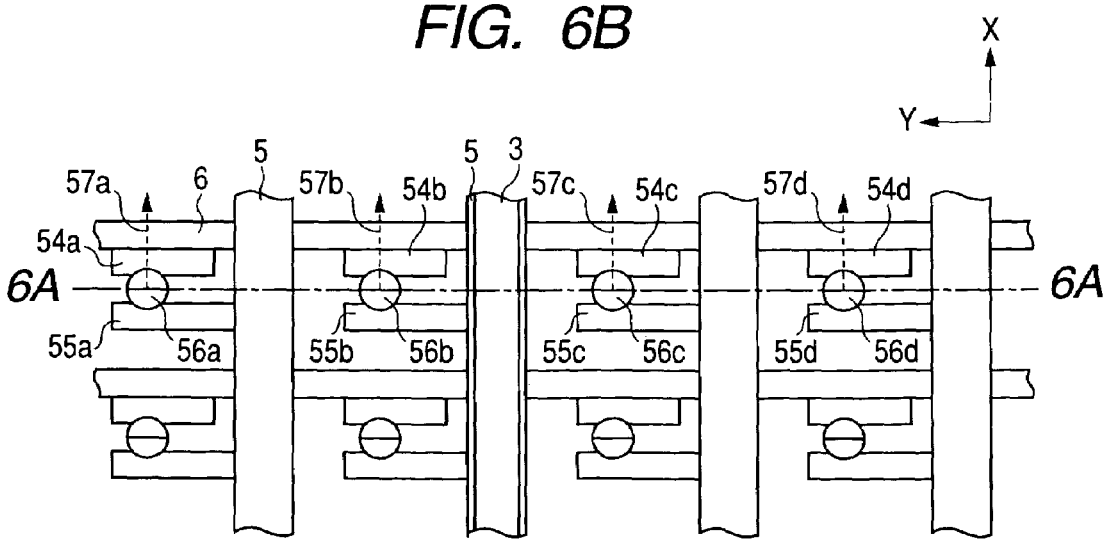

FIGS. 6A and 6B show the electron beam orbit 18 and the initial velocity vectors 57*a* to 57*d* in the case where the device electrodes 54*b* and 55*b*, and 54*c* and 55*c* of electron-emitting devices adjacent to the spacer 3 are provided without the angle of θ (i.e. in the case where the initial velocity vectors 57*b* and 57*c* are equal to the initial velocity vectors 57*a* and 57*d*). FIG. 6A is a sectional view taken on line 6A-6A of FIG. 6B.

As shown in FIG. 6B, the initial velocity vectors 57*a* to 57*d* of the electrons are equal to one another. However, as shown in FIG. 6A, the electron beam final arrival position is shifted by ΔS toward the spacer 3 by a potential distribution 20 formed by the spacer 3.

Figure 7A:
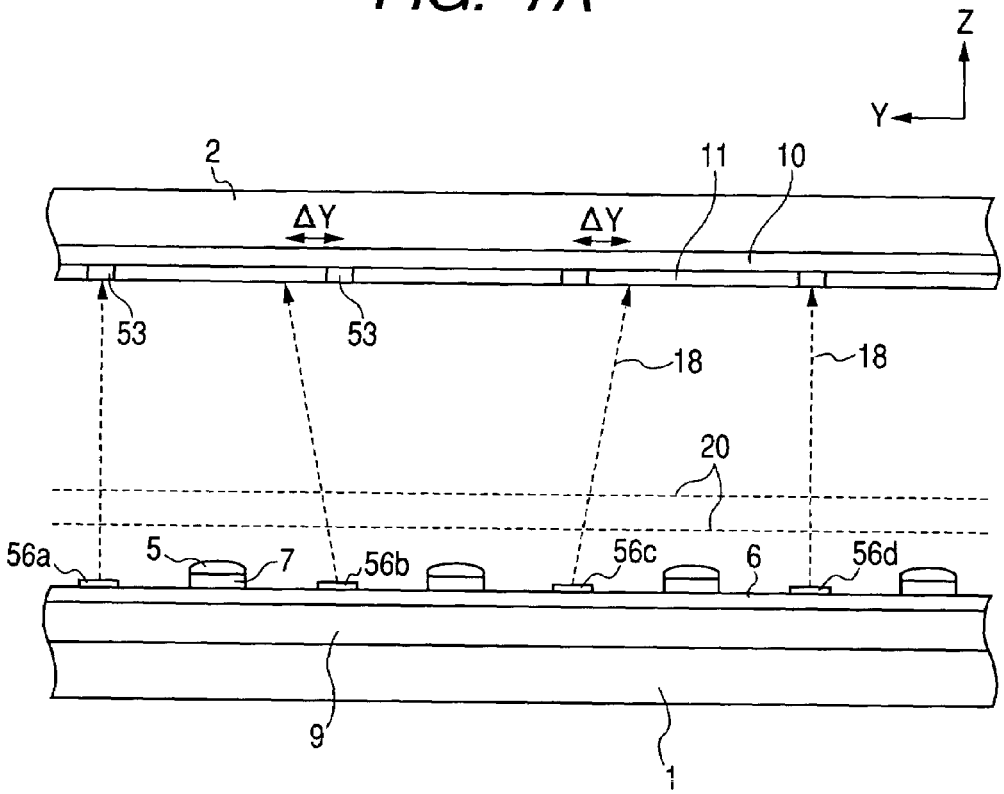
FIGS. 7A and 7B are a schematic view showing a configuration when the spacer is not formed in the display panel of FIGS. 5A and 5B.
Figure 7B:
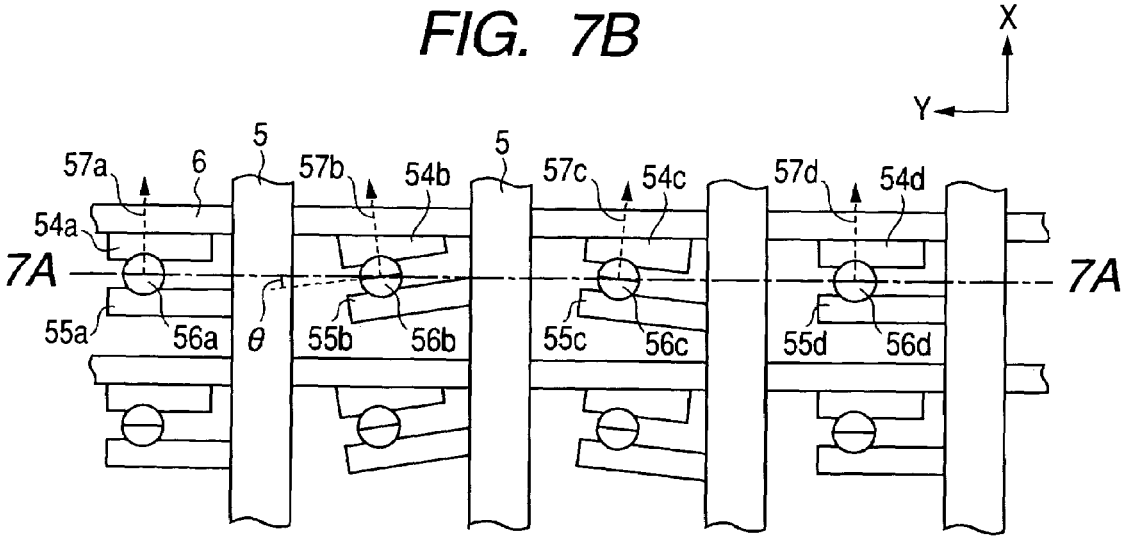

FIGS. 7A and 7B show the electron beam orbit 18 and the initial velocity vectors 57*a* to 57*d* in the case where the spacer 3 is removed in the same device electrode as for FIG. 5. FIG. 7A is a sectional view taken on line 7A-7A' of FIG. 7B.

Since the initial velocity vectors 57*a* and 57*d* of the electrons differ from the initial velocity vectors 57*b* and 57*c* as shown in FIG. 7B, the final arrival positions of the electron beams emitted with the initial velocity vectors 57*b* and 57*c* are separated away from an original predetermined irradiating position 53 by ΔY.

Figure 8:
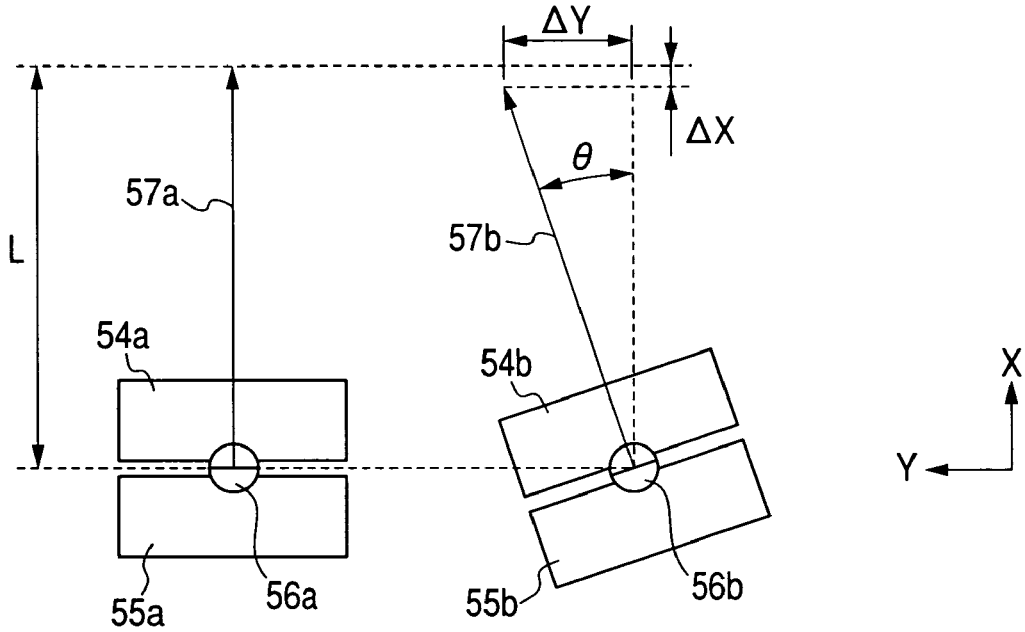
FIG. 8 is a view for explaining correction of irradiation point depending on an initial velocity vector in the display panel of FIGS. 5A and 5B.

Referring to FIG. 8, ΔY will be described in detail.

FIG. 8 is a schematic view showing the emitting point and arrival point of the electron. Starting points of arrows 57*a* and 57*b* indicate the emitting point, and end points of the arrows 57*a* and 57*b* indicate the arrival point. FIG. 8 corresponds to the perspective view from the upper side of the face plate 2 through the face plate 2.

The sign L is referred to as curve advancing amount (deflecting amount). The curve advancing amount (deflecting amount) L depends on magnitudes of the initial velocity vectors 57*a* and 57*b*. When the magnitudes of the initial velocity vectors 57*a* and 57*b* are equal to each other, the curve advancing amounts L are equal to each other. Namely, when the voltages applied between the devices are equal to each other, the curve advancing amount L are substantially equal to each other. Accordingly, the lengths of the arrows 57*a* and 57*b* of FIG. 8 are equal to each other. At this point, $$\Delta Y = L \times \sin\theta$$

The amount of shift also exists in the X-direction, $$\Delta X = L \times (1 - \cos\theta)$$

When θ is sufficiently small, ΔX is sufficiently small with respect to ΔY. For example, in the case of θ=10°, ΔX/ΔY is 0.09 or less.

Corresponding Position near Bottom Surface of Spacer 3

As described in FIG. 2, the high resistance film 52 of the spacer 3 is in "electrical contact" with the row directional wiring 5 in each intersecting portion between the row directional wiring 5 and the column directional wiring 6. Therefore, the potential of the non-contacting area 16 shown in FIG. 2B is raised, as shown in FIG. 5A, the equipotential line 20 having the upwardly convex shape is generated near the bottom surface of the spacer 3, and the electron beam 18 flies so as to be brought close to the spacer 3.

As described above, in the electron beam orbit design of the embodiment, it is thought that ΔS generated by the spacer 3 is compensated by ΔY by the angle of θ.

In the actual design, for example, the angle of θ in which the electron arrives at the predetermined irradiating position 53 and the contacting state are determined from the static field computation and the electron beam orbit simulation. It is also possible that the conditions are determined based on the measurement data.

EXAMPLE 1

In the display panel described in the embodiment, PD 200 (produced by Asahi Glass Co., Ltd.) is used as the substrate 51 of the spacer 3, and tungsten nitride/germanium nitride compound (WGeN) is deposited as the high resistance film 52 by simultaneously sputtering a tungsten target and a germanium target in nitrogen gas. At this point, deposition is performed by rotating the substrate 51 of the spacer 3. Therefore, the film thickness is 200 nm across the entire surface, and the sheet resistance is 2.5×1012 Ω/□. The thickness of the spacer 3 is set at 300 μm, and the height (Z-direction length) is set at 2.4 mm.

A SiO2 layer having the thickness of 0.5 μm is sputtered on the surface of the cleaned soda lime glass to form the rear plate 1. The device electrodes of the surface conduction electron-emitting device are formed on the rear plate 1 by the sputtering deposition method and the photolithography. For the material, Ti having the thickness of 5 nm and Ni having the thickness of 100 nm are laminated. The device electrode interval is set at 2 μm, and the device electrode angle θ of the device adjacent to the spacer 3 is set at 6.1°.

Then, the Ag paste is printed in the predetermined shape and baked at 480° C. to form the column directional wiring 6. The column directional wiring 6 extends to the outside of the electron source forming area to form the pieces of electron source driving wiring Dy1 to Dyn in FIG. 1. The width of the column directional wiring 6 is set at 100 μm, the thickness is set at about 10 μm, and the interval is set at 300 μm.

Then, the paste in which glass binder is mixed into the main content of PbO is used to form the interlayer insulating layer 7 by the printing. The interlayer insulating layer 7 electrically insulates the row directional wiring 5 from the column directional wiring 6. The thickness of the interlayer insulating layer 7 is set at about 20 μm.

The row directional wiring 5 is formed on the interlayer insulating layer 7 by the same technique as for the column directional wiring 6. The width of the row directional wiring 5 is set at 300 μm, the thickness is set at about 10 μm, and the interval is 920 μm. The row directional wiring 5 is extends to the outside of the electron source forming area to form the pieces of electron source driving wiring Dx1 to Dxm in FIG. 1.

Then, a Cr film is formed by the sputtering on the rear plate 1 in which the device electrodes 54*a* to 54*d* and 55*a* to 55*d* are formed, and openings corresponding to the shapes of the electroconductive thin films 56*a* to 56*d* are formed in the Cr film by the photolithography. Then, solution of organic Pd compound (ccp-4230: produced by OKUNO Chemical Industries Co., Ltd.) is applied and baked at 300° C. in atmosphere for 12 minutes to form a PdO fine-particle film. Then, the Cr film is removed by wet etching to form the electroconductive thin films 56*a* to 56*d* having the predetermined shapes by lift-off.

Finally, the fine-particle film is formed on the row directional wiring 5. The fine-particle film also functions as the antistatic film, and the fine-particle film is formed over the entire surface of the rear plate 1.

The fine oxide particles, in which antimony oxide is doped into tin oxide, are dispersed in a mix solution having a composition ratio of 1:1 of ethanol and isopropanol, and the fine oxide particles in the mix solution is used as the fine-particle film. Mass density of the solid material is set at about 0.1 mass %. A size of the fine particle ranges from 5 to 15 nm.

A spray method is used as the applying method. The application is performed using a spray apparatus on the conditions of a liquid pressure of 0.025 MPa, an air pressure of 1.5 kg/cm2, a substrate-head distance of 50 mm, and head moving speed of 0.8 m/sec. After the application, the baking is performed at 380° C. for 10 minutes. The thickness of the fine-particle film is 30 nm, and the sheet resistance is 1010 Ω/□.

In the invention, the material of the fine electroconductive particle is not limited to the tin oxide. It is also possible that the carbon materials, chrome oxide, and the like are preferably used as the fine electroconductive particle.

In the display panel produced by the above-described manner, when the image display is performed by setting the voltage applied to the metal back 11 at 15 kV and by setting the voltage applied between the row directional wiring 5 and the column directional wiring 6 at 14 V, the beam shift (ΔX) in the X-direction is less than a detection limit, and the good image can be displayed.

When the post-observation of the spacer 3 is performed, the electrical contacting length 42 estimated from the color change area is about 110 μm, and the gap 43 of the outermost portion of the electrical contacting length 42 of the 110 μm is about 3 μm, while the variations ranging from 0 to 100 μm exist in the physical contacting length 41.

According to the invention, "electrical contacting state" is realized between the wiring and the spacer by the electron emitted from the electron-emitting area on the wiring. Therefore, variations in physical contacting state between the wiring and the spacer can be relaxed, and assembly margin between the wiring and the spacer can be increased while the position shift of the electron beam arrival position is suppressed to maintain the good display image. Accordingly, the image forming apparatus having the good image display can be provided at a high yield.

This application claims priority from Japanese Patent Application No. 2004-191008 filed on Jun. 29, 2004, which is hereby incorporated by reference herein.

What is claimed is:

1. An image forming apparatus comprising:

a face plate which has a luminescent member and an electrode, the luminescent member emitting light by electron irradiation, the electrode being defined by a first potential;

a rear plate which has a wiring extending in a first direction and a plurality of electron-emitting devices arranged along the first direction and connected to the wiring, the wiring being defined by a second potential different from the first potential, and the plurality of electron-emitting devices irradiating the luminescent member with an electron; and a spacer arranged between the wiring and the electrode and electrically connected to the wiring and the electrode, the spacer having an end face which faces the rear plate, the end face having a resistivity, and the spacer extending longitudinally along the first direction;

wherein the end face of the spacer facing the rear plate includes contacting areas contacting the wiring and non-contacting areas spaced from the wiring, the contacting areas and the non-contacting areas being arranged in an interleaved relationship of abutting to each other along the first direction, and a fine particle film provided on at least the non-contacting areas of the wiring.

2. The image forming apparatus according to claim 1, wherein particle sizes of the fine electroconductive particles range from 5 nm to 15 nm.

3. The image forming apparatus according to claim 1, wherein the wiring is mainly made of silver, and the fine electroconductive particle is made of fine oxide particle in which antimony oxide is doped into tin oxide.

4. The image forming apparatus according to claim 1, wherein the contacting areas are provided at constant intervals along a direction in parallel with the wiring.

5. The image forming apparatus according to claim 4, wherein the electron-emitting device adjacent to the spacer is arranged at a position corresponding to the non-contacting areas between the contacting areas provided at constant intervals, and the electron-emitting device adjacent to the spacer emits the electron with an initial velocity vector different from that of the electron-emitting device which is not adjacent to the spacer.

* * * * *